US008156743B2

(12) United States Patent
Hessler et al.

(10) Patent No.: US 8,156,743 B2
(45) Date of Patent: Apr. 17, 2012

(54) METHOD AND ARRANGEMENT FOR EXPANDING A PRIMARY AND SECONDARY FLAME IN A COMBUSTOR

(75) Inventors: William Kirk Hessler, Greer, SC (US); Alberto Jose Negroni, Simpsonville, SC (US); Predrag Popovic, Simpsonville, SC (US); Krishna Kumar Venkataraman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1156 days.

(21) Appl. No.: 11/418,239

(22) Filed: May 4, 2006

(65) Prior Publication Data

US 2007/0256423 A1 Nov. 8, 2007

(51) Int. Cl.
*F02C 1/00* (2006.01)

(52) U.S. Cl. ..... 60/752; 60/772

(58) Field of Classification Search ..... 60/752, 60/772, 732, 733, 722, 246, 746–748
See application file for complete search history.

(56) References Cited

U.S. PATENT DOCUMENTS

| | | | | |
|---|---|---|---|---|
| 4,472,936 | A * | 9/1984 | Uchiyama et al. | 60/773 |
| 5,284,438 | A * | 2/1994 | McGill et al. | 431/9 |
| 5,285,631 | A * | 2/1994 | Bechtel et al. | 60/776 |
| 5,575,146 | A * | 11/1996 | Borkowicz et al. | 60/776 |
| 5,660,044 | A * | 8/1997 | Bonciani et al. | 60/737 |
| 5,735,126 | A * | 4/1998 | Schulte-Werning | 60/732 |
| 6,427,446 | B1 * | 8/2002 | Kraft et al. | 60/737 |
| 6,467,272 | B1 * | 10/2002 | Biondo et al. | 60/740 |
| 6,591,603 | B2 * | 7/2003 | Dressler et al. | 60/258 |
| 6,951,109 | B2 * | 10/2005 | Lemon et al. | 60/760 |
| 6,966,187 | B2 * | 11/2005 | Modi et al. | 60/752 |
| 2003/0233833 | A1 * | 12/2003 | Martling et al. | 60/776 |
| 2004/0103663 | A1 * | 6/2004 | Haynes et al. | 60/737 |
| 2004/0112058 | A1 * | 6/2004 | Garrido et al. | 60/752 |
| 2005/0144953 | A1 * | 7/2005 | Martling et al. | 60/752 |
| 2005/0144954 | A1 * | 7/2005 | Lemon et al. | 60/752 |
| 2005/0198965 | A1 * | 9/2005 | Henriquez et al. | 60/740 |
| 2006/0168967 | A1 * | 8/2006 | Simons et al. | 60/772 |
| 2009/0019855 | A1 * | 1/2009 | Venkataraman et al. | 60/738 |

* cited by examiner

*Primary Examiner* — Louis Casaregola
*Assistant Examiner* — Phutthiwat Wongwian
(74) *Attorney, Agent, or Firm* — Cantor Colburn LLP

(57) ABSTRACT

Disclosed is an arrangement for expanding an annular fluid flow and a center fluid flow, comprising a combustor including a venturi and a centerbody, the centerbody including an upstream end and a downstream end, and a venturi throat defined by the venturi and disposed upstream of 0.19 inches downstream of the downstream end of the centerbody.

13 Claims, 5 Drawing Sheets

METHOD AND ARRANGEMENT FOR EXPANDING A PRIMARY AND SECONDARY FLAME IN A COMBUSTOR

FIELD OF THE INVENTION

This disclosure relates generally to a combustor with improved emissions performance, and more particularly to a combustor with improved emissions performance and stability.

BACKGROUND OF THE INVENTION

Gas turbines comprise a compressor for compressing air, a combustor for producing a hot gas by burning fuel in the presence of the compressed air produced by the compressor, and a turbine to extract work from the expanding hot gas produced by the combustor. Gas turbines are known to emit undesirable oxides of nitrogen (NOx) and carbon monoxide (CO). Existing dry low NOx combustors (DLN combustors) minimize the generation of NOx, carbon monoxide, and other pollutants. These DLN combustors accommodate fuel-lean mixtures while avoiding the existence of unstable flames and the possibility of flame blowouts by allowing a portion of flame-zone air to mix with the fuel at lower loads. However, NOx emissions requirements are becoming more stringent, and therefore, the art is need of a lower NOx emission combustor that will not reduce combustor stability or increase CO emissions.

BRIEF DESCRIPTION OF THE INVENTION

Disclosed is an arrangement for expanding an annular fluid flow and a center fluid flow, comprising a combustor including a venturi and a centerbody, the centerbody including an upstream end and a downstream end, and a venturi throat defined by the venturi and disposed upstream of 0.19 inches downstream of the downstream end of the centerbody.

Also disclosed is a method for arranging components to produce an expansion of an annular fluid flow and a center fluid flow in a combustor, comprising disposing a venturi throat radially outwardly of a centerbody of the combustor, and disposing the venturi throat upstream of 0.19 inches downstream of a downstream end of the centerbody.

Additionally disclosed is a method for reducing NOx emissions by enhancing flame stability and reducing CO emissions in a combustor, comprising directing an annular fluid flow toward a centerbody of the combustor, the directing occurring upstream of 0.19 inches downstream of a downstream end of the centerbody, expanding the annular fluid flow away from the centerbody, the expanding occurring upstream of 0.19 inches downstream of the downstream end of the centerbody, drawing a center fluid flow radially outwardly via the expanding, and increasing a centerline recirculation region size.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several Figures.

DETAILED DESCRIPTION OF THE INVENTION

Figure 1:
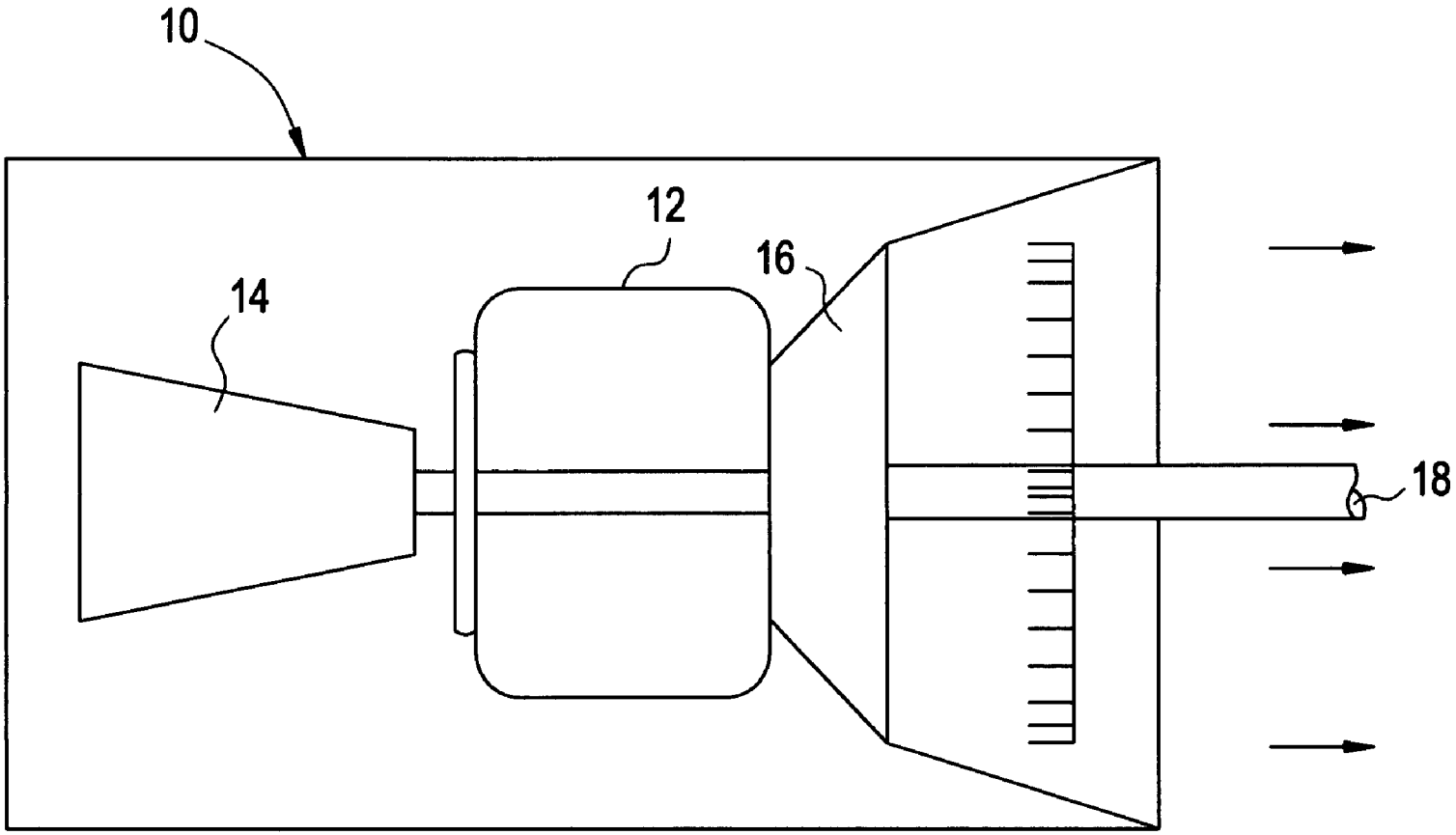
FIG. 1 is a schematic of a gas turbine.

For clarity and perspective, an example of a combustor in association with a gas turbine is shown in FIG. 1. It is to be understood that the disclosed arrangement (an arrangement for expanding an annular fluid flow and a center fluid flow) has applicability beyond the turbine shown in FIG. 1, and thus, the turbine in FIG. 1 should not be considered limiting to the disclosure.

As shown in FIG. 1, a gas turbine 10 includes a combustor 12 located in a gas flow path between a compressor 14 and a turbine 16. The turbine 16 is coupled to the compressor 14, which it rotationally drives, and a power output drive shaft 18. Air enters the gas turbine 10 and passes through the compressor 14. High pressure air from the compressor 14 enters the combustor 12 where it is mixed with fuel and burned. High energy combustion gases exit the combustor 12 and expand in the turbine 16, whereby energy is extracted. In addition, the turbine 16 drives the output power shaft 18.

Figure 2:
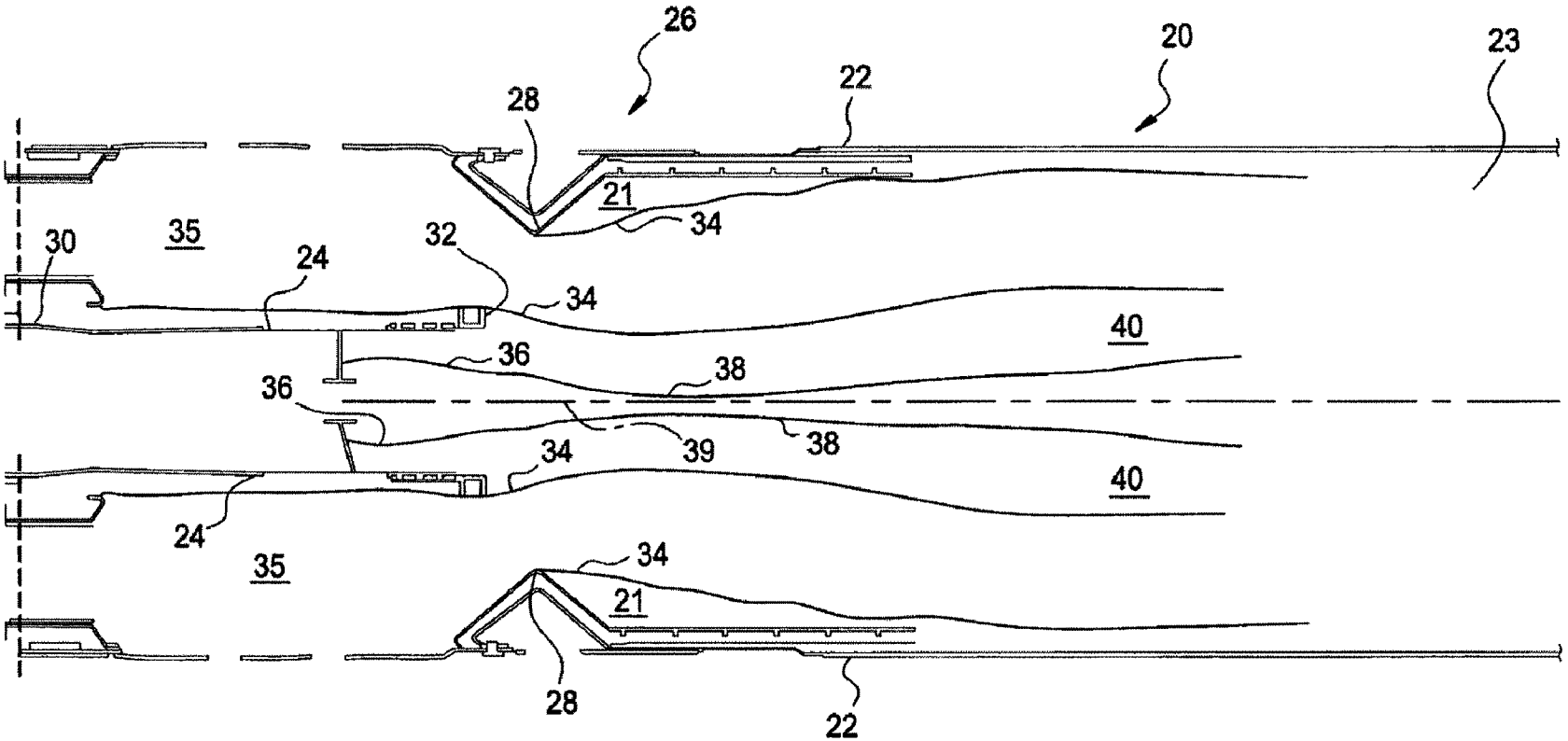
FIG. 2 PRIOR ART
FIG. 2 is a schematic cross section view of a combustor.

Referring to FIG. 2, a combustor 20 (which could be used in the gas turbine 10 of FIG. 1) defining a liner cavity 23 and including a venturi 22 and a centerbody 24 is illustrated. The centerbody 24 includes an upstream end 30 and a downstream end 32. The venturi 22 defines a venturi throat 28 that is disposed radially outwardly of the centerbody 24. The venturi throat 28 (as shown in FIG. 2) is disposed downstream of the downstream end 32 of the centerbody 24, and an annular cavity 35 is disposed annularly outwardly about the centerbody 24. From this annularly cavity 35, an annular fluid flow 34 flows into and past a recirculation region 21 of the liner cavity 23. Also flowing into the liner cavity 23 is a center fluid flow 36, which flows from the centerbody 24.

Because the venturi throat 28 is disposed downstream of the downstream end 32, the annular fluid flow 34 is directed by the venturi throat 28 toward the center fluid flow 36, after the annular fluid flow 36 has exited the annular cavity 35. In this type of arrangement 26, the annular fluid flow 34 impinges upon the center fluid flow 36 downstream of the downstream end 32, creating a pinching 38 of the center flow 36 in a centerline recirculation region 39 of the liner cavity 23. The pinching effect tends to destabilize combustor flames thereby making combustion dynamics or blow-out a greater probability. In addition (when the venturi throat 28 and the downstream end 32 are arranged in this manner), it is not until after the annular fluid flow 36 has passed both the downstream end 32 of the centerbody 24 and the venturi throat 28 that it may expand and create a lower pressure region 40 that will facilitate expansion of the center fluid flow 36. This delays interaction of a flame (not illustrated) associated with the center fluid flow 36 and a flame (not illustrated) associated with the annular fluid flow 34.

Figure 3:
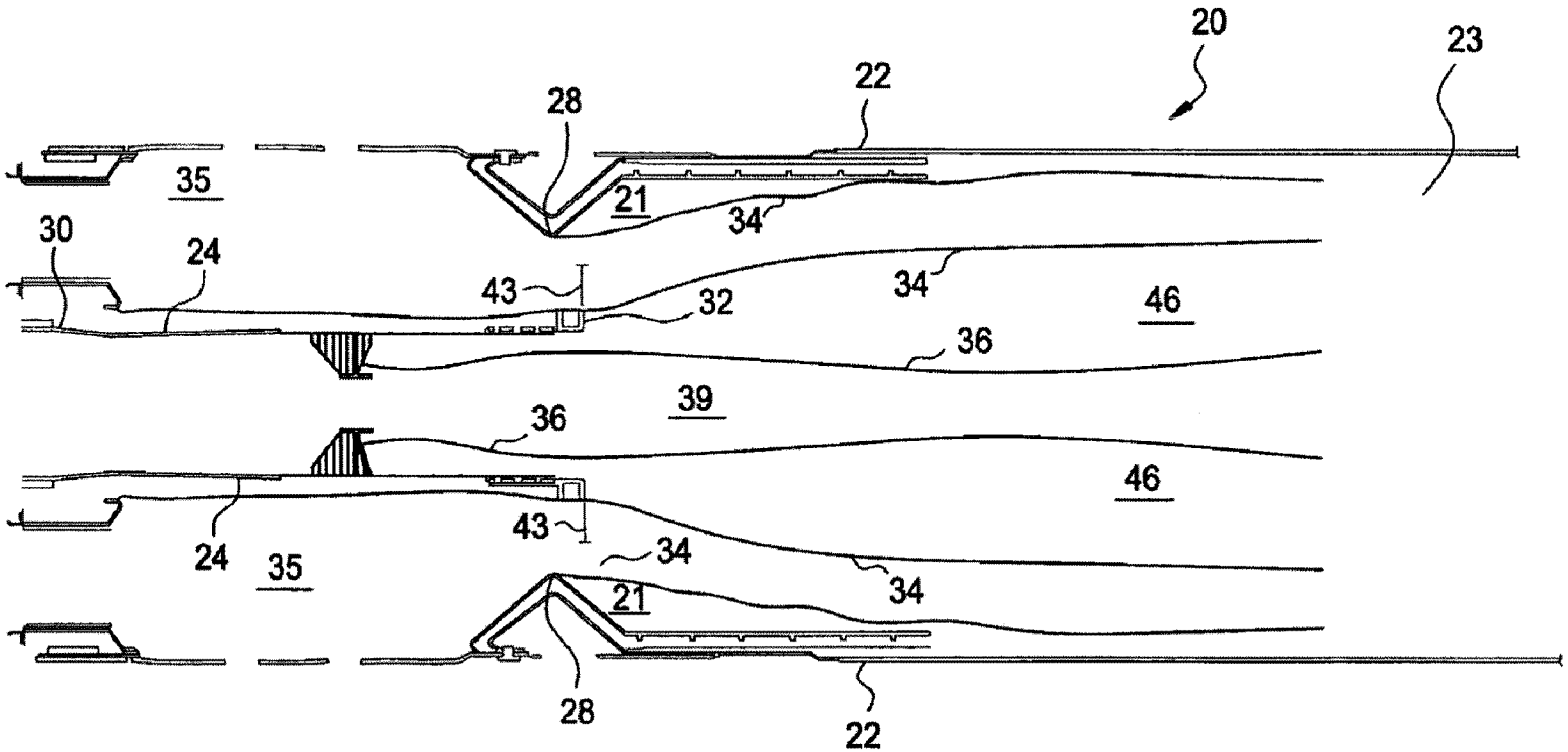
FIG. 3 is a schematic cross section view of a combustor including components in an arrangement that improves expansion of an annular fluid flow and a center fluid flow in accordance with an exemplary embodiment.

Referring to FIG. 3, the venturi throat 28 and downstream end 32 of the centerbody 24 are illustrated in an exemplary embodiment of an arrangement 42 that improves expansion of the annular fluid flow 34 and center fluid flow 36 in the recirculation region 21, thereby simultaneously improving both NOx reduction and flame stability. In this arrangement 42, the venturi throat 28 is disposed less than 0.19 inches downstream of the downstream end 32 of the centerbody 24. The venturi throat 28 may be disposed less than 0.19 inches downstream of the downstream end 32 of the centerbody 24 by moving or extending the centerbody 24 downstream, or moving the venturi throat 28 upstream within the venturi 22. In an exemplary embodiment, such as that which is shown in FIG. 3, the venturi throat 28 is disposed 0.5 inches upstream of the downstream end 32 of the centerbody 24. In another exemplary embodiment, the venturi throat 28 is disposed 0.31 inches upstream of the downstream end 32 of the centerbody 24. The venturi throat 28 may also be disposed coplanar to (or in a same plane 43 with) the downstream end 32 of said centerbody 24.

By disposing the venturi throat 28 upstream of the downstream end 32 of the centerbody 24 in these exemplary embodiments, the annular fluid flow 34 is directed by the venturi throat 28 toward the centerbody 24, with the directing occurring upstream of the downstream end 32 of the centerbody 24. By positioning the venturi throat 28 in this manner, the annular fluid flow 34 will begin to expand before moving downstream of the downstream end 32 of the centerbody 24. Since the annular fluid flow 34 is already expanding as it passes the downstream end 32 of the centerbody 24, it does not restrict the expansion of the center fluid flow 36 but creates a lower pressure region 46 to which the center fluid flow 36 will be exposed upon entry to the liner cavity 23. This lower pressure region 46 facilitates expansion of the center fluid flow 36 with the annular fluid flow 34.

Earlier expansion of the center fluid flow 36 (in terms of fluid flow direction, and as compared with a component arrangement of FIG. 2) enhances center fluid flow 36 recirculation in the recirculation region 21, which allows a faster interaction between the flame (not illustrated) associated with the center fluid flow 36 and the flame (not illustrated) associated with the annular fluid flow 34. This faster interaction reduces cold streaks in the combustor 20, and improves NOx emissions performance by decreasing CO emissions at a given NOx level, thereby facilitating the combustor 20 to run at a leaner fuel-air mixture and thus produce less NOx emissions. Earlier expansion also eliminates pinching 38, which increases centerline circulation region 39 size, and improves combustor 20 stability. It should be appreciated that in an exemplary embodiment, the combustor 20 is a dry low NOx combustor, which utilizes fuel-lean mixtures and does not use diluents (e.g., water injection) to reduce flame temperature.

Figure 4:
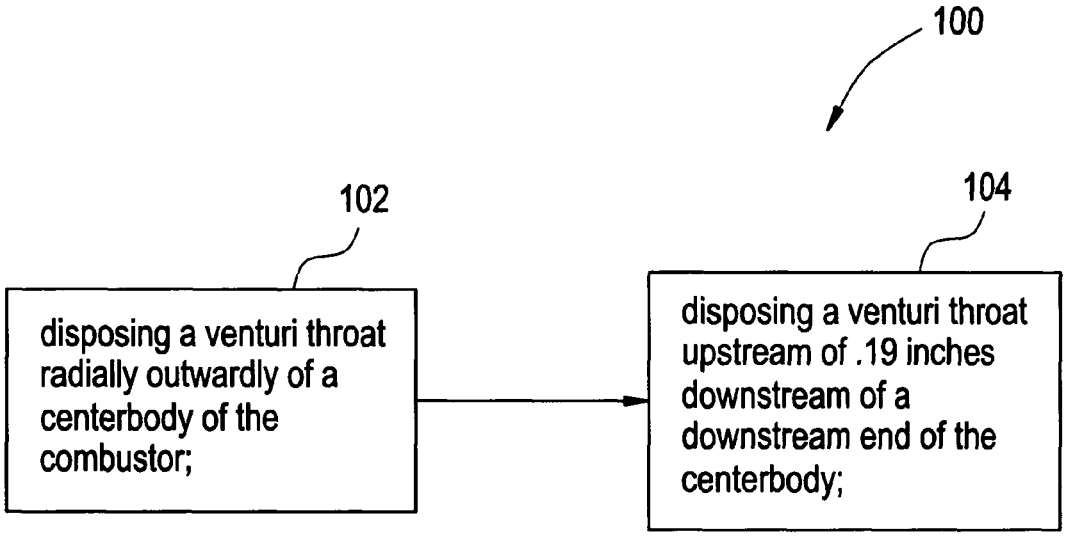
FIG. 4 is a block diagram illustrating a method for arranging components to produce an expansion of an annular fluid flow and center fluid flow in a combustor.

Referring to FIG. 4, a method 100 for arranging components to produce an expansion of an annular fluid flow 34 and center fluid flow 36 in a combustor 20 is illustrated and includes disposing a venturi throat 28 radially outwardly of a centerbody 24 of the combustor 20, as shown in Operational Block 102. The method 100 also includes disposing the venturi throat 28 upstream of 0.19 inches downstream of a downstream end 32 of the centerbody 24, as shown in Operational Block 104. As was mentioned above, upstream disposal of the venturi throat 28 may be achieved by either moving the centerbody 24 downstream or moving the venturi throat 28 upstream. It should be appreciated that in an exemplary embodiment, the venturi throat 28 is disposed upstream or coplanar with the downstream end 32 of said centerbody 24.

Figure 5:
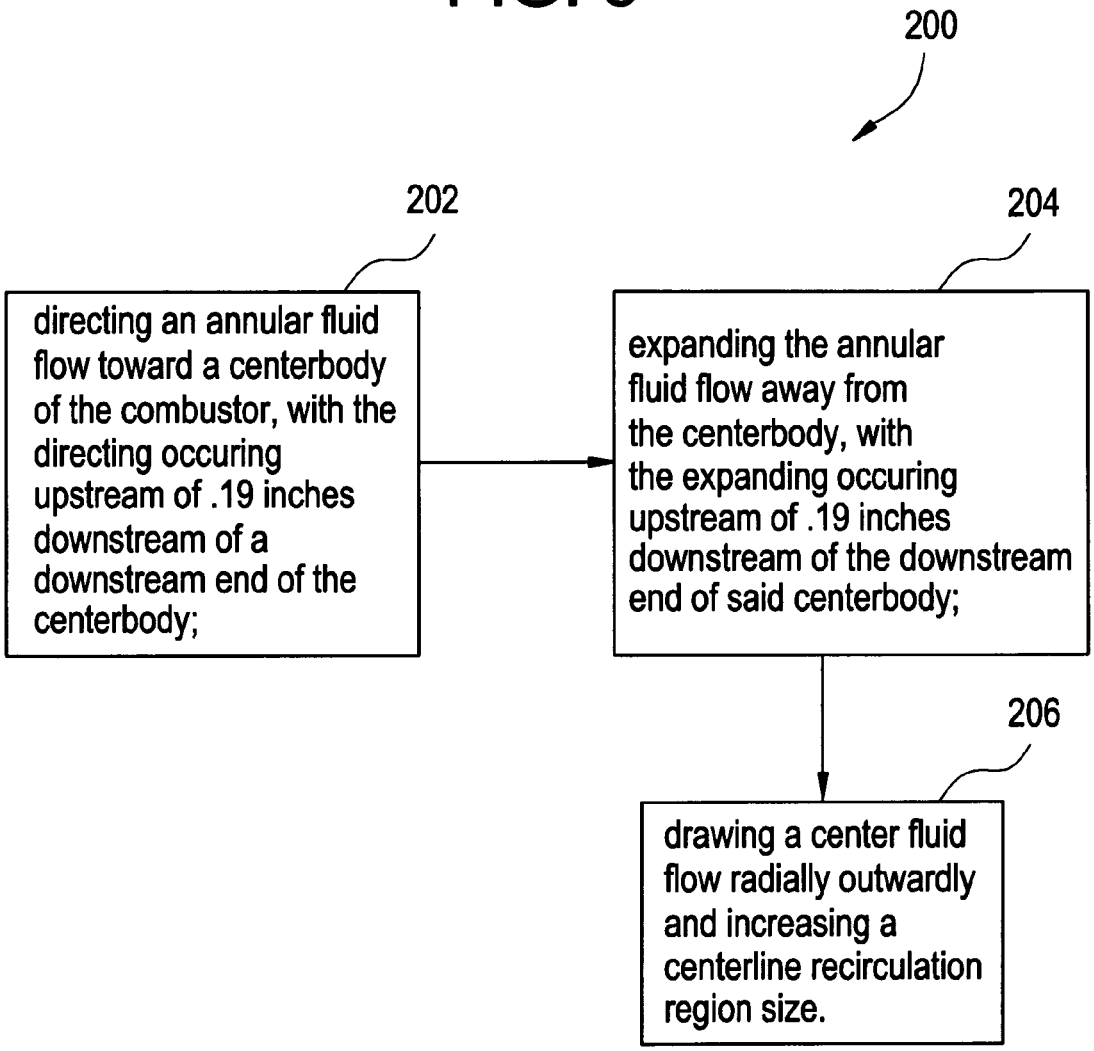
FIG. 5 is a block diagram illustrating a method for reducing NOx emissions while enhancing flame stability in a combustor.

Referring to FIG. 5, a method 200 for reducing NOx emissions by enhancing flame stability and reducing CO emissions in a combustor 20 is illustrated and includes directing an annular fluid flow 34 toward a centerbody 24 of the combustor 20, with the directing occurring upstream of 0.19 inches downstream of a downstream end 32 of the centerbody 24, as shown in Operational Block 202. The method 200 also includes expanding the annular fluid flow 34 away from the centerbody 24, with the expanding occurring upstream of 0.19 inches downstream of the downstream end 32 of said centerbody 24, as shown in Operational Block 204, and drawing a center fluid flow 36 radially outwardly via the expanding and increasing a centerline recirculation region size, as shown in Operational Block 206. It should be appreciated that in an exemplary embodiment the directing and expanding occurs upstream or coplanar with the downstream end 32 of said centerbody 24.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. An arrangement for expanding an annular fluid flow and a center fluid flow in a gas turbomachine, the arrangement comprising:

a gas turbomachine combustor including a combustion chamber, a venturi and a centerbody arranged within the combustion chamber, the venturi including a converging section and a diverging section, said centerbody including an upstream end and a downstream end; and a venturi throat defined by said venturi between the converging section and diverging section, said venturi throat being disposed entirely upstream of the downstream end of the centerbody.

2. An arrangement according to claim 1, wherein said venturi throat is disposed from about 0.31 inches upstream of said downstream end of said centerbody to about 0.5 inches upstream of said downstream end of said centerbody.

3. An arrangement according to claim 1, wherein said combustor is a dry low NOx combustor.

4. The arrangement according to claim 1, wherein the venturi is V-shaped in cross-section.

5. An arrangement for expanding an annular fluid flow and a center fluid flow in a gas turbomachine, the arrangement comprising:

a gas turbomachine combustor disposed in a gas flow path between a compressor and a turbine within a gas turbine, said gas turbomachine combustor including a combustion chamber, a venturi and a centerbody arranged within the combustion chamber, the venturi including a converging section and a diverging section, said centerbody including an upstream end and a downstream end; and a venturi throat defined by said venturi between the converging section and diverging section, said venturi throat being disposed entirely upstream of the downstream end of the centerbody.

6. The arrangement according to claim 5, wherein the venturi is V-shaped in cross-section.

7. A method for arranging components to produce an expansion of an annular fluid flow and a center fluid flow in a gas turbomachine combustor, the method comprising:

disposing a venturi throat arranged between a converging section and a diverging section of a venturi positioned within a combustion chamber radially outwardly of a centerbody of the gas turbomachine combustor; and disposing said venturi throat entirely upstream of a downstream end of the centerbody.

8. A method according to claim 7, wherein said disposing includes said venturi throat being disposed from about 0.31 inches upstream of the downstream end of said centerbody to about 0.5 inches upstream of said downstream end of said centerbody.

9. A method for reducing NOx emissions by enhancing flame stability and reducing CO emissions in a gas turbomachine combustor, the method comprising:

directing an annular fluid flow through a converging section of a venturi toward a centerbody of the gas turbomachine combustor including a combustion chamber, said directing occurring entirely upstream of a downstream end of the centerbody;

expanding said annular fluid flow away from said centerbody through a diverging section of the venturi, said expanding occurring entirely upstream of the downstream end of the centerbody;

drawing a center fluid flow radially outwardly via said expanding; and increasing a centerline recirculation region size.

10. A method according to claim 9, wherein said directing of said annular fluid toward said centerbody is occurring from about 0.31 inches upstream of said downstream end of said centerbody to about 0.5 inches upstream of said downstream end of said centerbody.

11. A method according to claim 9, wherein said expanding of said annular fluid away from said centerbody is occurring substantially coplanar relative to said downstream end of said centerbody.

12. A method according to claim 9, wherein said expanding of said annular fluid away from said centerbody is occurring from less than 0.19 inches downstream of said downstream end of said centerbody to about 0.5 inches upstream of said downstream end of said centerbody.

13. A method according to claim 12, wherein said expanding of said annular fluid away from said centerbody is occurring from about 0.31 inches upstream of said downstream end of said centerbody to about 0.5 inches upstream of said downstream end of said centerbody.

* * * * *